United States Patent [19]

Puchala et al.

[11] Patent Number: 4,640,644

[45] Date of Patent: Feb. 3, 1987

[54] METHOD AND APPARATUS FOR REMOVAL OF SURFACE MATERIAL

[75] Inventors: Ryszard J. Puchala, Scarborough; Stephen J. Miko, Toronto, both of Canada

[73] Assignee: Indescor Hydrodynamics Inc., Concord, Canada

[21] Appl. No.: 722,454

[22] Filed: Apr. 12, 1985

[30] Foreign Application Priority Data

Apr. 16, 1984 [CA] Canada ..... 452,066

[51] Int. Cl.[4] ..... E01C 23/12; E21C 25/60

[52] U.S. Cl. ..... 404/75; 404/90; 299/17; 299/36

[58] Field of Search ..... 404/90, 75; 241/101.7, 241/1, 301; 299/16, 17, 36, 37, 39; 173/22, 43, 44, 45, 42, 39

[56] References Cited

U.S. PATENT DOCUMENTS

| | | | |
|---|---|---|---|
| 2,423,787 | 7/1947 | Mosena et al. | 299/37 X |
| 2,878,002 | 3/1959 | Haley | 299/36 |
| 3,172,483 | 3/1965 | Spitzer | 173/22 X |
| 3,538,803 | 11/1970 | Joseph | 241/1 X |
| 3,614,163 | 10/1971 | Anderson | 299/17 |
| 3,729,137 | 4/1973 | Cobb et al. | 239/101 |
| 3,792,907 | 2/1974 | Anderson | 299/17 |
| 3,857,516 | 12/1974 | Taylor | 299/17 |
| 3,910,815 | 10/1975 | Shelor | 239/186 X |
| 4,081,200 | 3/1978 | Cheung | 299/17 |

FOREIGN PATENT DOCUMENTS 3240544 4/1984 Fed. Rep. of Germany ... 241/101.7

OTHER PUBLICATIONS

6th Int'l Symposium on Jet Cutting Technology, BHRA Fluid Engineering, Cranfield, Bedford, U.K., Apr. 1982.

*Primary Examiner*—James A. Leppink
*Assistant Examiner*—Matthew Smith
*Attorney, Agent, or Firm*—George A. Rolston

[57] ABSTRACT

Apparatus for removing material from a surface, for use in association with a source of water at a pressure within the range of about 10,000 to 25,000 psi, the apparatus comprising, a carriage vehicle, extendable arm mounted on the vehicle and defining a free end, a nozzle being movable in a transverse direction, the nozzle including a housing and a rotatable nozzle mounted thereto, a hose connecting the source of water to the nozzle, a motor attached to the nozzle operable to rotate the nozzle, and an extender attached between the arm and the vehicle operable to extend and retract the arm relative to the vehicle.

14 Claims, 8 Drawing Figures

METHOD AND APPARATUS FOR REMOVAL OF SURFACE MATERIAL

THE NATURE OF THE INVENTION

The invention relates to a method and a device using pressurized water for removing surface concrete from various concrete structures. In particular, the invention may be applied to remove old, unsound concrete from the surface of various concrete structures, leaving a sound concrete base upon which a new surface may be laid.

BACKGROUND OF THE INVENTION

From time to time, the surfaces of roads, highways, bridges, parking lots and the like must be replaced. Constant exposure to traffic and weather limit the useful life of such surfaces and resurfacing is necessary. In many instances a new surface cannot simply be applied to the old surface. In some instances, there may be a structure above the surface. In order to maintain a minimum pre-determined clearance between such structure and such surface (for the passage of trucks and other vehicles, for example), the surface cannot be built up. Rather, replacement is necessary. In other instances, the addition of a new surface on top of the old may increase the dead weight of the structure above its design capacity. In such an instance, replacement of the surface is necessary. As well, in most instances, a satisfactory bond between a sound old surface and the new surface is required.

In yet other cases, it may be desirable to build or join a new concrete structure to an old concrete structure. In order to ensure a strong connection therebetween, the old surface of the original structure may have to be removed.

Various methods and devices exist for removing a concrete surface from a concrete structure.

A common such device is a pneumatic jack hammer. Jack hammers suffer from numerous disadvantages when used to remove a large surface area. They make a substantial amount of noise and vibration, which may greatly inconvenience the public. A single jack hammer can only be effectively used to break up a relatively small surface. Consequently, a large number of hammers and human operators are needed to remove a large surface area within a reasonable amount of time. These labour and equipment requirements add significantly to the cost of the surface removal. An operator, being in close proximity to the hammer and to its dust and debris, may be exposed to health and safety hazards. Furthermore, jack hammers may damage the substrate beneath the concrete surface and reinforcing bars or mesh in the concrete. Vibrations may damage neighbouring concrete structures that are sound and not intended for removal.

Rotary cutters suffer from similar problems, and in addition are subject to significant wear and are slow.

In order to overcome the above problems, devices using pressurized water have been proposed. Rock or concrete drilling or removing machines may use pressures up to about 150,000 psi. In this specification, a pressure less than 10,000 psi will be described as high pressure. A pressure between 10,000 and 25,000 psi will will be described as extra-high pressure. A pressure above 25,000 psi will be described as ultra-high pressure.

In one such device, a stream of ultra-high pressure water essentially cuts or erodes away the concrete. Such devices are to be contrasted with high pressure devices which are only able to be used to clean and scour a surface. In a known concrete removing device as for example disclosed in U.S. Pat. No. 4,081,200, water is pressurized to between 25,000 and 60,000 psi, that is to the ultra-high pressure range. In contrast, in the concrete scouring devices, high pressures or even pressures up to about 15,000 psi have been used. Conventional devices have not generally been able to make use of extra-high pressures for the satisfactory removal of concrete.

In the known concrete removing device, the ultra-high pressure water is passed through at least one small diameter nozzle to form a high energy water jet. Water jets developed from such ultra-high pressures may be sufficient to remove all structural concrete, both sound and unsound, to depths up to at least 3 inches.

In the system of U.S. Pat. No. 4,081,200 the jet nozzle was directed at a pre-determined fixed angle, and traversed along an arcuate path. The jet was extremely fine and produced essentially a cutting action, removing a narrow, but deep portion of concrete. Broken concrete apparently created a problem, and the system was designed to progressively remove it. In order to use these ultra-high pressure, the nozzle was extremely fine, and located close to the work face.

The ultra-high pressures involved resulted in high kinetic forces sufficient to break up sound concrete. This however is not always necessary, or even desirable. Such a device removed old concrete both sound and unsound leaving a generally level surface upon which new concrete could be poured. An important disadvantage of such device is that significant time and energy may be wasted on the removal of sound concrete, when it may not be necessary to do so. Extra cost will be incurred in replacing, unnecessarily, the sound concrete.

Another disadvantage is that the vehicle, upon which the ultra-high pressure device is mounted, must be advanced at a generally constant, yet slow, rate of speed. In most instances, a human operator would be unable to effectively control the vehicle speed for efficient concrete removal. Therefore, an expensive automatic speed controlling mechanism must be used.

Yet another disadvantage is that the nozzle assembly, which is only a fraction of the width of the vehicle, must be positioned at a particular location on its frame. During operation the assembly is fixed relative to the vehicle. The nozzle assembly can generally only remove concrete from an area directly beneath itself. Consequently, concrete can only be removed across a fraction of the width of the vehicle.

In order to overcome the above disadvantages, it would be advantageous to provide a pressurized-water concrete removing device suitable for removing essentially only unsound concrete from the surface of a concrete structure. Such operation would be analogized to the removal of a decayed area in a tooth by a dentist. Essentially, only the decayed, or unsound portion would be removed, leaving only the sound material. A relatively small amount of sound material might incidentally be removed to ensure that all of the unsound material had been removed. Such operation would allow for increased speed of concrete removal, and yet provide a suitable substrate surface, upon which a new surface could be placed.

The ultra-high pressure concrete removing device described above could conceivably be operated by hand to remove only unsound material, much like the manner in which a dentist manipulates his drill by hand. However, because of the difficulty and slow speed of manually identifying and removing all areas of unsound concrete, such operation would not be practical. Automatic operation is preferable, but automatic operation of the ultra-high pressure device removes all concrete down to a particular level.

It would therefore be advantageous to provide an automatic device which would treat both the sound and the unsound concrete in the same way at the same time.

Preferably such a device would traverse over good and bad concrete alike, and would remove all of the bad, but only minor portions of the good concrete.

In this way when a new surface was applied, the quantity of new material required for resurfacing would be minimized. Also, the volume of loose, dislodged old material, which would have to be removed, is minimized.

Preferably the system would provide a degree of sweeping action or turbulence which would carry dislodged material away from the work face. Kinetic forces would be sufficient to break up unsound concrete, while high volume flow rates in a turbulent flow pattern would effectively carry loose debris away from the immediate vicinity of the work face.

It would also be advantageous to provide a device which could be operated manually, if so desired. While automatic operation is advantageous, it may be desired to use the device to remove only small, unconnected patches of unsound concrete. In such cases, manual operation of the device may be preferred.

It would also be advantageous to provide a concrete removing device that allows a vehicle, upon which the device is mounted, to remain stationary or that requires it to move only intermittently.

A further advantage would be obtained by providing for a nozzle assembly that traversed across at least a significant portion of the width of the vehicle.

A concrete removing device using pressurized water and possessing the above advantages, of course, would also have all the advantages of a pressurized water system over standard pneumatic jack hammer or rotary cutter concrete removal devices.

STATEMENT OF THE INVENTION

With a view to providing the above advantages, the invention comprises an apparatus for removing material from a surface, for use in association with a source of water at a pressure within the range of about 10,000 to 25,000 psi, the apparatus comprising a carriage vehicle means, extendible arm means mounted on the vehicle and defining a free end, transverse nozzle support member attached to the free end of the arm, rotatable nozzle means movably attached to the support member, the nozzle means being movable in a transverse direction, the nozzle means including a housing and a rotatable nozzle mounted thereto, transverse movement means for transversely moving the nozzle means along the support member, hose means connecting the nozzle means operable to rotate the nozzle means, and extender means attached between the arm and the vehicle means operable to extend and retract the arm relative to the vehicle means.

The invention further comprises a method for removing material from a surface comprising the steps of pressurizing water to a pressure within the range of about 10,000 to 25,000 psi, passing said pressurized water through nozzle means, directing at least two separate water jets from said nozzle means, oriented at two different angles relative to a vertical axis, rotating such nozzle means whereby to establish a circular path for at least one of such water jets on such surface to establish turbulent water flow thereon to break up material and to wash away loose material, traversing the nozzle in a first direction from one side to another to define a scan, and moving the nozzle intermittently in a second direction perpendicular to the first direction at the completion of at least one scan.

The invention achieves the above advantages in the following ways. First, water is pressurized to between about 10,000 and 25,000 psi, that is, to within the extra-high pressure range. A relatively high flow of pressurized water is passed through a relatively large diameter rotating nozzle. The water is formed into at least one rotating water jet. The rotating water jet is directed onto the concrete surface to be removed. The rotating jet of water erodes and applies reactive pressures to the surface, sufficient to break up and remove unsound concrete. Satisfactory flow rates for the water have been found in the range of 45 to 115 liters per minute. This is to be contrasted with U.S. Pat. No. 4,081,200 teaching a flow rate of about 30 litres per minute and pressures of 25,000 to over 60,000 psi. The apparatus of U.S. Pat. No. 4,081,200 may be operated to slowly remove all surface concrete—including both sound and unsound concrete—down to a particular level. However, the method and apparatus of the invention may be operated to remove only unsound concrete down to the same pre-determined level. The sound concrete which remains will generally define an undulating surface, having bumps and hollows.

Second, the rotation of the water jet of the invention allows a circle of concrete up to about 3.5 inches in diameter to be removed. Transverse movement of the nozzle apparatus allows a swathe about 3.5 inches across to be removed from the concrete. The rotational movement of the jet causes turbulence and broken concrete material is washed away from the immediate vicinity of the work face and removed efficiently to the desired depth. The defective concrete material may be removed to the desired depth in one pass of the nozzle apparatus having a suitable transverse speed.

Third, the nozzle apparatus is attached to an extendable arm. Upon completion of one transverse pass from side to side, the arm and nozzle apparatus can be advanced an appropriate increment without moving the vehicle.

Fourth, the use of a rotating nozzle apparatus allows for a maximum length of transverse movement—essentially, from one side of the supporting vehicle to the other.

Fifth, lifting jacks are provided on the vehicle to ensure stable positioning of the vehicle during the concrete removal operation.

Sensors are provided for sensing height above the work face, and lateral and longitudinal position, and automatic controls maintain optimum positioning, and rate of travel, for the rotating spray head.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
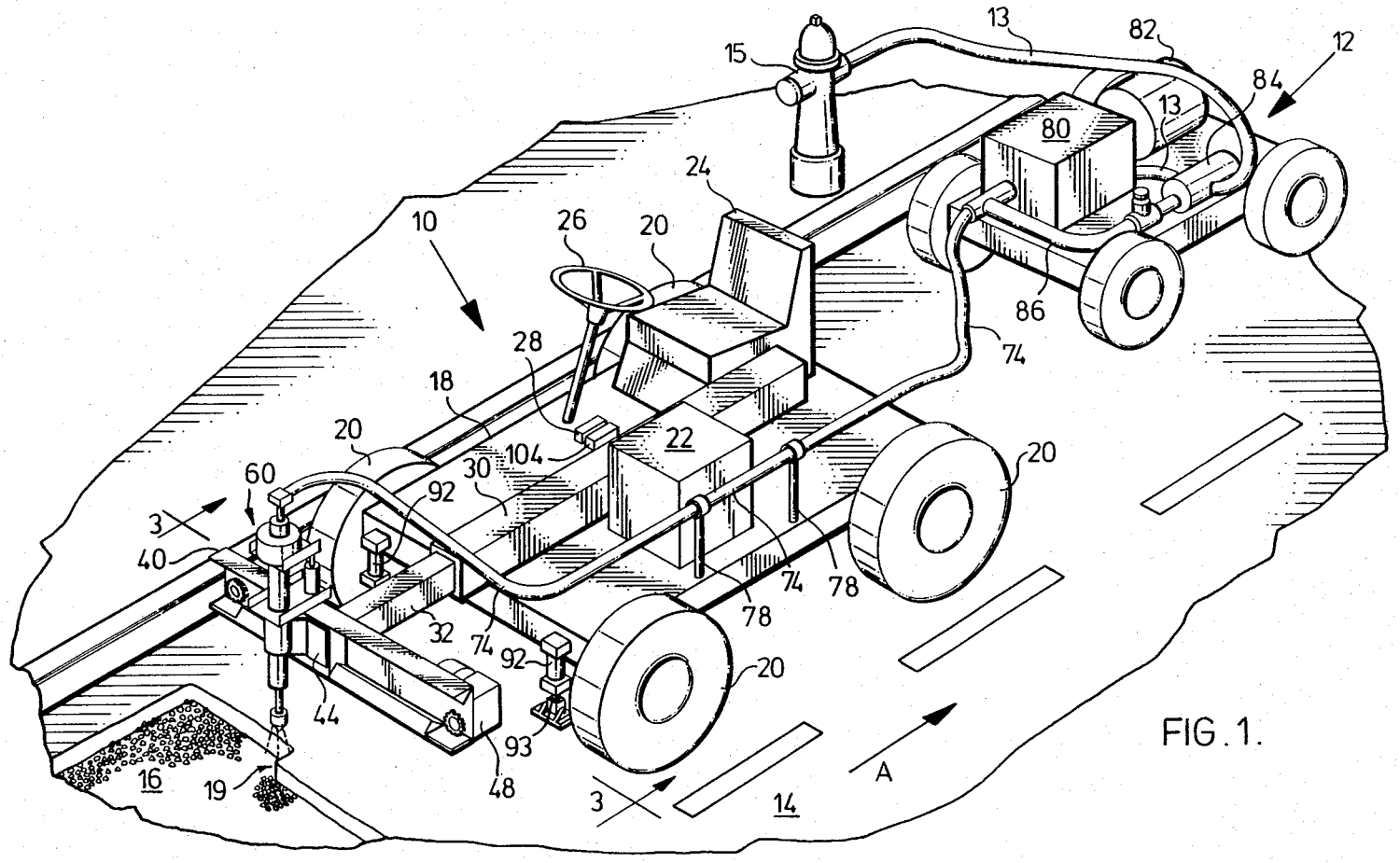
FIG. 1 is a perspective view of a vehicle, to which is mounted one embodiment of the invention, in operation.

Referring to FIG. 1, there is shown a concrete removing vehicle 10, according to the invention. Vehicle 10 is connected to a pumping vehicle 12. Concrete removing vehicle 10 may tow pumping vehicle 12 or they may each be separate and independent vehicles. In certain situations it may even be desirable to mount the necessary apparatus for both concrete removing and pumping operations on a single vehicle. In other situations, it is possible for pumping vehicle 12 to be remotely located from concrete removing vehicle 10. Pumping vehicle 12 is connected by a hose 13 to any suitable source of water, such as hydrant 15. Vehicle 10 is illustrated as resting on old concrete road surface 14. Vehicle 10 removes concrete from old surface 14 in the direction generally indicated as A. When the old unsound concrete surface 14 has been removed by vehicle 10, as described below, a generally undulating substrate surface 16, of old yet sound concrete, remains in the wake of vehicle 10. Substrate surface 16 is generally left covered with rubble 17 (see Figure), which is the broken up old surface 14. Rubble 17 may be subsequently removed by any suitable means such as by shovel or other means, to expose substrate surface 16. Of course, rubble 17 must be removed prior to laying a new concrete surface. As described below, rubble 17 is removed from the immediate vicinity of work face 19 of old surface 14 so as not to interfere with the concrete removal operation.

It will be appreciated that, although vehicle 10 is shown as reversing in the direction of arrow A, vehicle 10 could be operated equally as well in a forward direction. In such a case, vehicle 10 would have to rest on substrate surface 16 or rubble 17 and point in the direction of arrow A.

Vehicle 10 comprises a chassis 18 to which are mounted wheels 20. Vehicle 10 is driven by a suitable motor 22, shown schematically, mounted to the chassis 18. Suitable transmission means (not shown) connect motor 22 to wheels 20. An operator (not shown) may sit at seat 24 on chassis 18. From this position, the operator may control vehicle 10 by means of steering wheel 26, connected by suitable means to wheels 20, and vehicle controls 28, shown schematically.

All of the above components are well known in the art. They are described merely in order to be able to fully describe the invention and its operation. They are not intended to limit the invention in any way, rather, it is intended that the scope of the invention cover any embodiment of the invention mounted to any suitable carriage vehicle.

Figure 2:
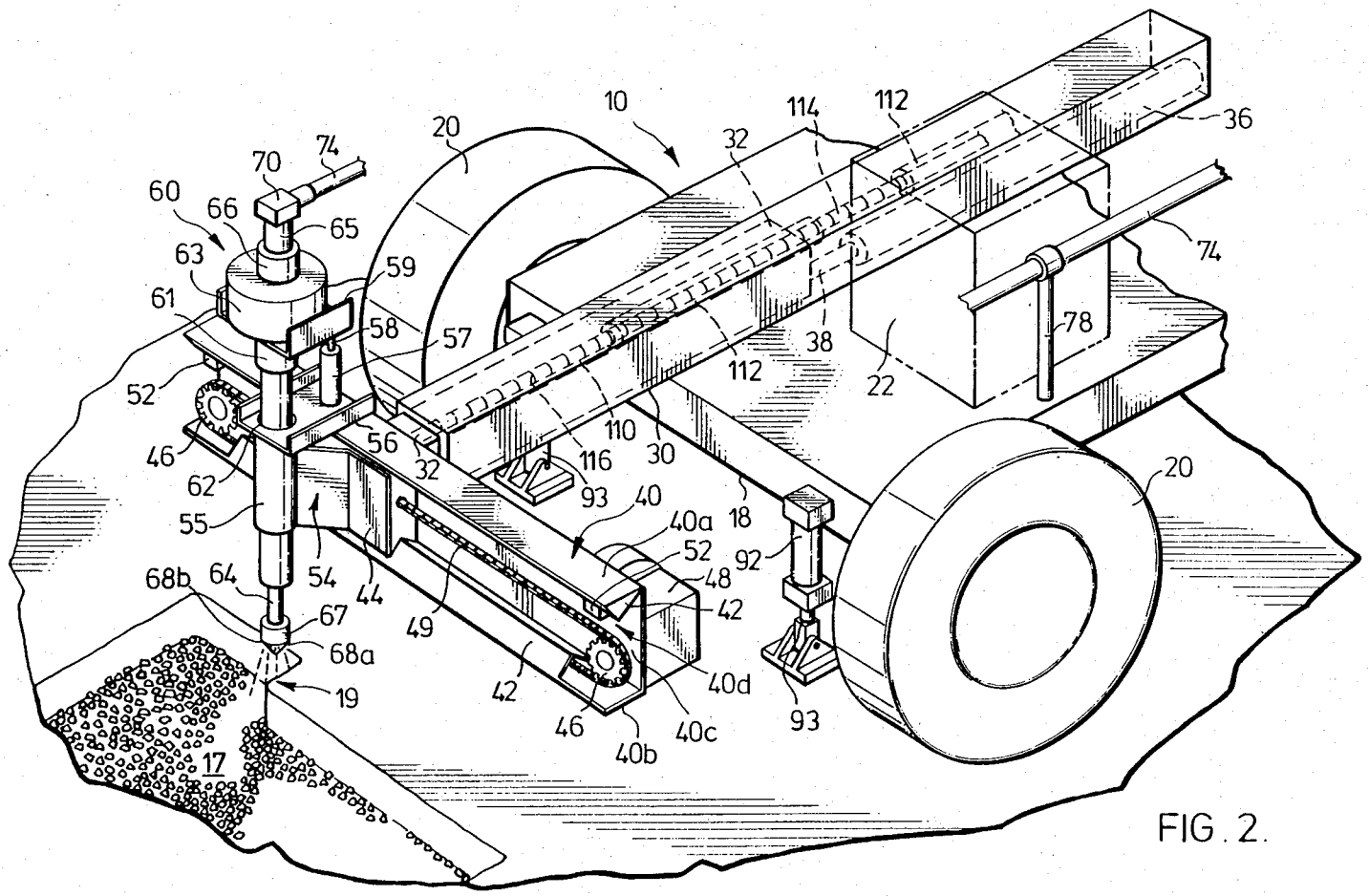
FIG. 2 is a close up partially cut a way view of the front portion of the vehicle of FIG. 1.
Figure 3:
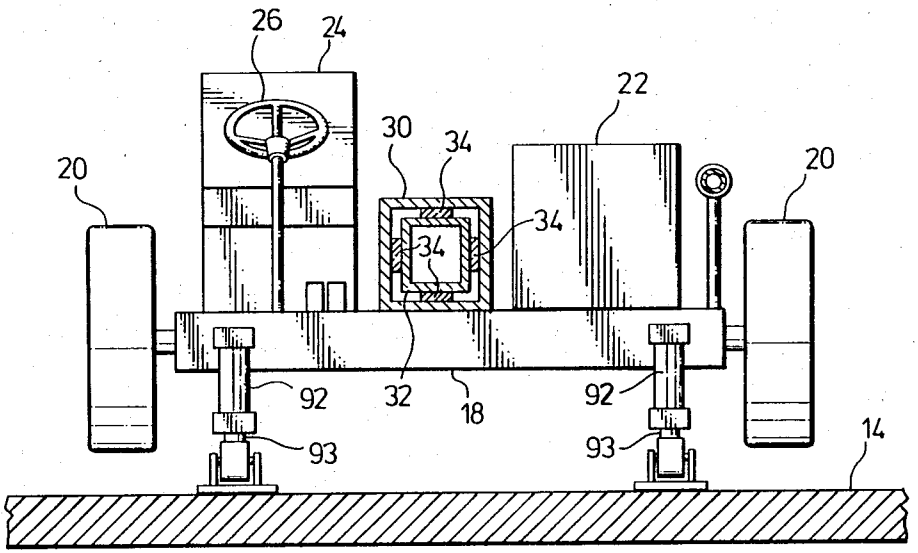
FIG. 3 is a cross-section along the line 3—3 of FIG. 1.

Extending forwardly from chassis 18 is a sleeve member 30. In the illustrated embodiment sleeve member 30 defines a rectangular cross-section, although other shapes may be used. Slidably, or telescopically, received within sleeve member 30 is extension arm 32. Extension arm 32 rests upon slide pads 34 (see FIG. 3) mounted to the interior of sleeve member 30. A hydraulic cylinder 36 (see FIG. 2) is mounted to sleeve member 30. An operating rod 38 of cylinder 36 is affixed to extension arm 32, whereby operation of hydraulic cylinder 36 will cause extension arm 32 to either extend from or retract into sleeve member 30, as desired.

Extension arm 32 defines a forward end to which is transversely mounted a nozzle support member 40.

Figure 4:
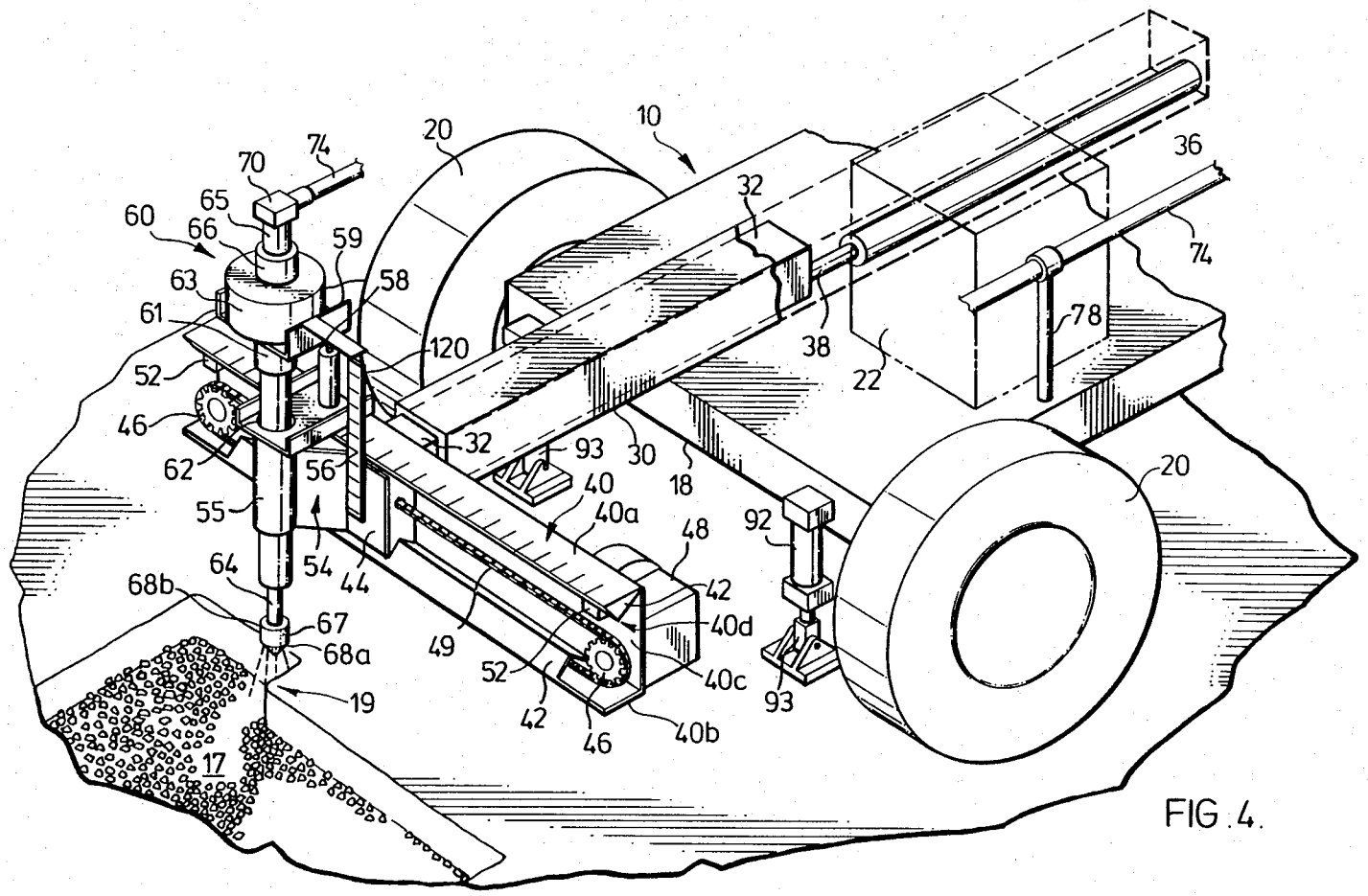
FIG. 4 is a close up perspective view of a front portion of the vehicle of FIG. 1.

Referring to FIG. 4, member 40 preferably defines a generally channel-shaped cross section, having upper and lower flange members **40*a* and 40*b* joined by web 40*c* and defining channel 40*d* therebetween. Bearing blocks 42 are mounted to flanges 40*a* and 40*b* facing inwardly within the channel 40*d*. Head support block 44 is slidably mounted to and between bearing blocks 42. Adjacent each end of nozzle support member 40 there is rotatably moutned a sprocket means 48, which may be a hydraulic motor. Motor 48 may be affixed to the rear side of web 40*c* and connected to sprocket 46 by a suitable shaft (not shown). A suitable chain 49 interconnects the sprockets 46 and connects sprockets 46 to head support block 44**.

It will be appreciated that, although a motor/sprocket/chain mechanism has been illustrated for driving the head support block 44 from side to side, other suitable driving mechanisms may be used.

Also limit switches such as 52 are located adjacent each end of nozzles support member 40. An electrical signal from either of limit switches 52 may be used to control the operation of motor means 48, whereby to prevent the further transverse motion of head support block 44 past the limit switch 52. The electrical signal from limit switch 52 may also be used to initiate by suitable electrically activated actuator means (FIG. 7), an incremental movement of extension arm 32.

It will be appreciated that limit switches 52 may be movably mounted by suitable mounting means (not shown) to support member 40. Adjustment of the positioning of limit switches 52 will thus set the limits of the transverse movement of head support block 44.

Figure 7:
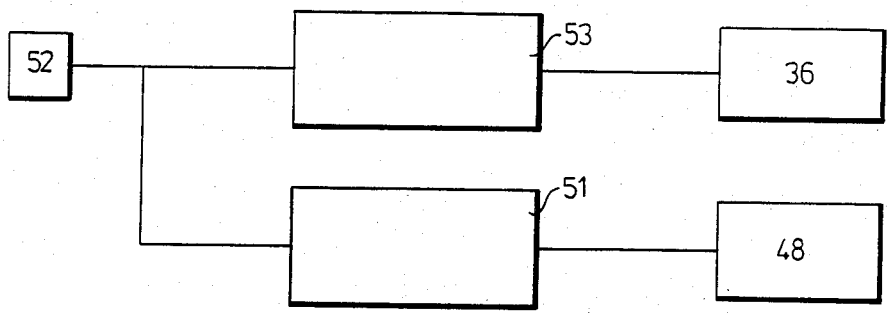
FIG. 7 is a schematic diagram of an alternate control system as may be installed in an alternate embodiment of the invention; and, FIG. 8 is a perspective, partially cut away drawing of a debris shroud as may be installed in an embodiment of the invention.

Referring to FIG. 7, the signal from a limit switch 52 may be used in two ways. First, the signal may be delivered to a reverse or stop means 51. Reverse or stop means 51, upon receipt of such a signal is operable to either reverse the direction of or stop motor 48, as may be pre-selected by the operator. Second, the signal from limit switch 52 may be delivered to an extension actuator means 53, operable upon receipt of such a signal to extend (or retract, as desired) extension arm 32 a suitable pre-determined increment. Such extension operation is achieved by connecting extension actuator means 53 to hydraulic cylinder 36.

Mounted to head support block 44 is nozzle support frame 54. Support frame 54 includes a generally vertical cylindrical sleeve member 55, mounted to block 44 fowardly on nozzle support member 40, and a cantilever arm 56. Cantilever arm 56 is attached to cylindrical sleeve member 55 and extends rearwardly above upper flange 40*a*. A hydraulic cylinder 57 is mounted to cantilever arm 56 and extends upwardly. An operating rod 58 of hydraulic cylinder 57 is fixed to nozzle holder member 59.

A nozzle apparatus, indicated generally as 60, includes a housing 61 which is mounted to nozzle holder member 59. Housing 61 extends downwardly from nozzle holder member and is slidably mounted within cylindrical sleeve member 55. Suitable bearing or bushing means 62 may be provided for easy vertical movement.

Nozzle apparatus 60 includes a nozzle motor means 63, which in the illustrated embodiment is a hydraulic motor. Nozzle motor 63 is operable to rotatably drive hollow nozzle shaft 64, which is rotatably mounted within housing 61. The hollow interior of shaft 64 is in communication with an inlet manifold 65 through a suitable rotating seal means 66, both of which may be mounted within housing 61. A free end of shaft 64 extends outwardly of the bottom of housing 61 and defines nozzle 67. Nozzle 67 includes at least one nozzle orifice 68. In the illustrateed embodiment two such orifices 68*a* and 68*b* are defined. Nozzle 67 is oriented more or less vertically. Orifices 68*a* and 68*b* preferably define different angles with respect to a vertical axis. However, one or more orifices 68 may define vertical axes, if desired for particular operations. Orifices 68*a* and 68*b* are in communication via the hollow interior of shaft 64 with the inlet manifold 65.

Suitable inlet fittings 70 are attached to inlet manifold 65 for introducing extra-high pressure water thereinto.

In the illustrated embodiments extra-high pressure water is introduced into nozzle apparatus by hose 74. Hose 74 is connected by fittings 70 to nozzle apparatus 60. Hose 74 passes back towards chassis 18 along extension arm 32 and sleeve member 30. Hose 74 is sufficiently long so that extension arm 32 may extend fully without damaging or interfering with hose 74. However, hose 74 is not so long that it will drag on surface 14 when extension arm 32 is in the fully retracted position. Alternatively, suitable hose support means (not shown) may be provided to prevent hose 74 from touching the ground when arm 32 is in the retracted position. Hose 74 passes rearward above chassis 18. Hose 74 may be supported in a pre-determined position by hose support members 78. Hose 74 extends rearward from vehicle 10 to pumping vehicle 12. Throughout its length hose 74 may be comprised of various sections joined by suitable union means.

Pumping vehicle 12 includes an extra-high pressure pump 80, driven by suitable motor means 82, which may conveniently be an internal combustion engine. The inlet of pump 80 is connected by hose 13 to a header tank 84, which is in turn connected to a suitable source of water, such as hydrant 15. A bypass hose 86 connects the pump outlet back to header tank 84. The outlet of pump 80 is connected to hose 74. Suitable valve means (not shown) control the flow of water from hydrant 15 to tank 84, and from the pump outlet, to hose 80, or to bypass hose 86. In this way the pump motor 82 can be run continuously while the jets at nozzle 67 are operated intermittently, as required, without damage to the pump and motor.

Hydraulic cylinders 92 are affixed to chassis 18 of vehicle 10 adjacent each wheel 20. Hydraulic cylinders 92 are oriented in an essentially vertical direction, whereby extension of an operating arm 93 of a cylinder 92 may operate to jack a wheel 20 off of road surface 14 (see FIG. 3).

Figure 5:
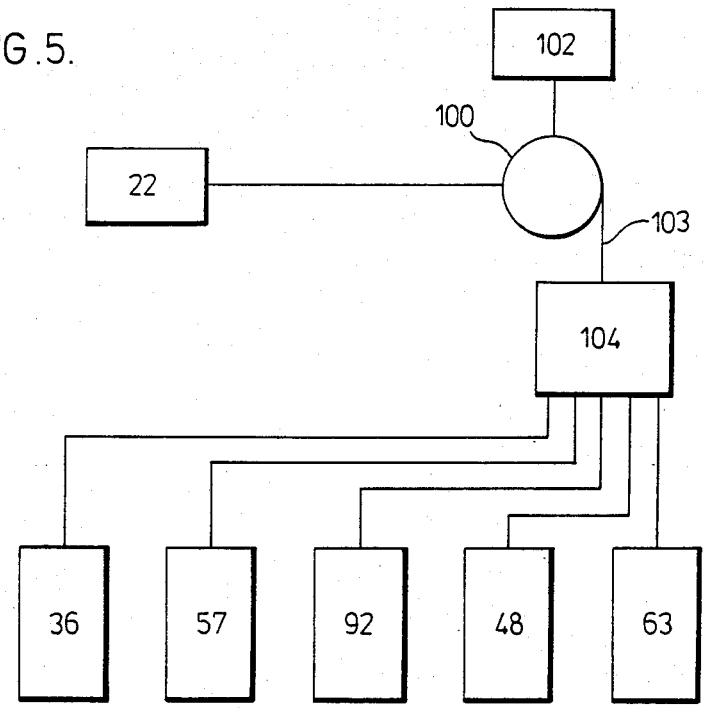
FIG. 5 is a schematic diagram of the hydraulic system of the vehicle of FIG. 1.

Referring to FIG. 5, vehicle motor 22 includes a suitable power take off means (not shown) connected to a hydraulic pump 100. The intake of pump 100 is connected to a reservoir 102, containing a suitable hydraulic fluid. The outlet of pump 100 is connected by suitable hydraulic lines 103 to each of hydraulic cylinders 36, 57, and 92 as well as to hydraulic motors 48 and 63. Suitable controls, indicated schematically as 104, are provided to allow the operator to individually control the operation of hydraulic cylinders 36, 57, and 92 as well as motors 48 and 63.

Suitable indicators are provided so that the position of nozzle 67 with respect to work face 19 may be easily identified by an operator. In the illustrated embodiment, a graduated rod 110 is mounted to nozzle support member 40. Rod 110 extends rearwardly adjacent sleeve member 30. Rod 110 extends through and is supported by, but freely slidable within a sleeve 112. Sleeve 112 defines a gap or aperture 114 through which graduation marks 116 marked on rod 110 may be conveniently viewed by an operator. Marks 116 are conveniently placed at a distance corresponding to the width of the swathe cut by extra-high pressure water issuing from nozzle 67, as described below. It will be appreciated that other indicator means may be used to indicate the position of extension arm 32 relative to sleeve 30.

Similarly, the vertical position of nozzle apparatus 60 relative to nozzle support member 40 may be conveniently measured. A graduated L-shaped measuring arm 120, mounted to housing 61 or nozzle holder member 59, extends downwardly. The position of nozzle 67 may be determined by observing the graduation marks, as they pass the top of nozzle support member 40 or some other suitable pointer fixed relative thereto. Again, it will be appreciated that other indicator means may be used to indicate the position of nozzle 67 relative to nozzle support member 40.

The transverse position of nozzle 67 may simply be determined by observing the position of nozzle apparatus 60 or cantilever arm 62 relative to nozzle support member 40. The top of member 40 may be provided with suitable graduation marks. Other indicator means may be used.

Figure 6:
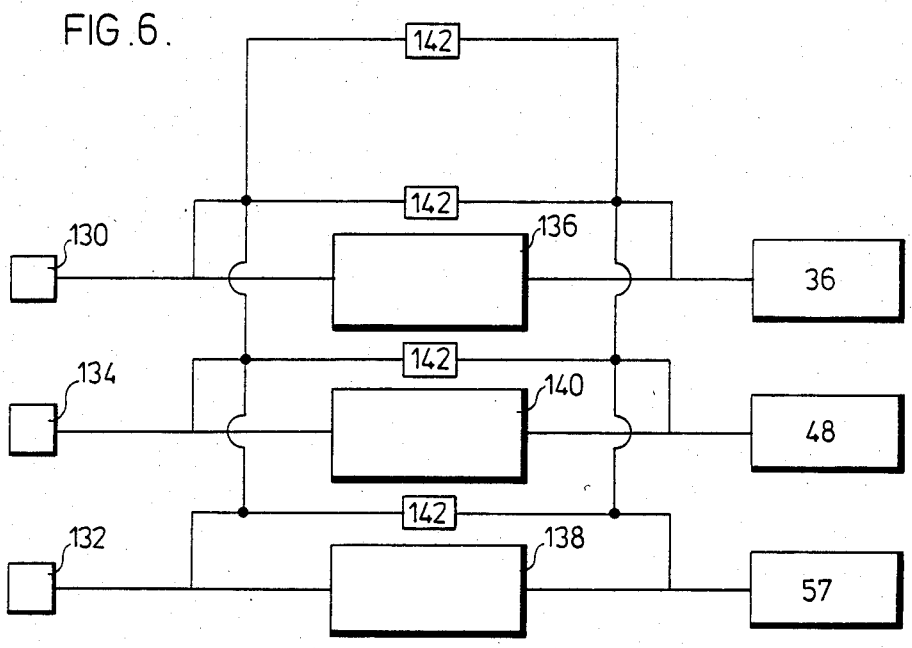
FIG. 6 is a schematic diagram of an automatic control system as may be installed in one embodiment of the invention.

It will also be appreciated that with suitable position transducers and controller means, the operation of the concrete removing operation may be fully automated. FIG. 6 schematically illustrates generally such an automatic system. Position transducers 130, 132, and 134 proivde signals, electrical or otherwise, regarding the extension position of arm 32, the vertical position of nozzle 67, and the transverse position of nozzle 67, respectively. Such signals are respectively delivered to extension position controller means 136, vertical position controller means 138 and transverse position controller means 140. Controller means 136, 138, and 140 are connected respectively to hydraulic cylinder 36, hydraulic cylinder 57 and hydraulic motor 48. Suitable manual override means 142 may also be provided to manually override controller means 136, 138, and 140, whereby a human operator is able to manually control the position of the nozzle regardless of its actual position.

In operation, the vehicle is positioned over the work face, and jacks 92 are operated to raise wheels 20 off the surface. Extension arm 32 typically will be extended to its furthest extension. Nozzle support head 44 will be located at one end of nozzle support member 40. Water is introduced into pump 80 from hydrant 15 through hose 15. Motor 82 is set to run steadily at a predetermined speed. Pump 80 pressurizes the water into the extra-high pressure range. Extra-high pressure water passes from pump 80 through hose 74 to nozzle apparatus 60. The extrahigh pressure water passes through orifices 68*a* and 68*b* of nozzle 67, thereby defining two jets of high pressure watre. Each of the jets defines a different angle with respect to the vertical. Motor 63 operates to rotate nozzle 67. Each jet, therefore traces out a generally conical shape, the cone defined by one jet lying within the cone defines by the other jet. The two jets strike old road surface 14 and apply erosion and reaction forces thereto. Such forces are sufficient to cut or dislodge old unsound concrete, leaving most of the sound concrete. The two jets acting in co-operation with each other have been found to be sufficient to generally remove all old unsound concrete lying with the cones of the jets, typically a circle or swathe of concrete about 3.5 inches across. The turbulent rotating action of the jets clears dislodged old material from the immediate vicinity of work face 19, so that the jets are applied directly on the face, and not onto loose material.

In certain embodimemts, it may be desired to orient one or more orifices 68 vertically. In such a case, the jets may trace out a cylindrical shape, which may have advantages in particular situations.

According to the age and constituent parts of the particular concrete, motor 48 is set at and acts at a pre-determined speed. Motor 48 operates to cause nozzle apparatus 60 to move transversely along nozzle support member 40. The transverse speed of nozzle apparatus 60 defines a pre-determined rate to ensure that all old unsound concrete extending to a particular depth below surface 14 can be removed. Accordingly, in one transverse scan from one side of nozzle support member 40 to the other side of nozzle support member 40 all such old unsound concrete may be removed to the desired depth. Alternatively, if for any reason such operation should not be practical, the concrete may be removed to the desired depth with two or more scans.

As nozzle apparatus 60 moves transversely along nozzle support member 40 it will contact a limit switch 52 at one end of nozzle support member 40. If another scan along the same path is to be performed, the electrical signal from limit switch 52 may be delivered to the reversing means 52 for revresing the operation of motor 48. However, if only one scan is required the signal from limit switch 52 may be delivered to a suitable stop means 51 for stopping transverse motion and to an extension actuator means 53 for actuating hydraulic cylinder 36. Similary, when the nozzle apparatus 60 reaches the other end of nozzle support member 40, the other limit switch 52 may operate in corresponding fashion.

When one (or more) transverse scans has been completed, hydraulic cylinder 36 is operated to retract extension arm 32 a pre-determined increment related to the maximum width of concrete removed in the previous scan or scans. Such operation may be achieved manually, upon receipt of the operator of information that the desired scans have been completed, or extension actuator 53 may be provided for the automatic operation of hydraulic cylinder 36.

The nozzle support head 44 is again traversed to achieve a scan or scans over the new work, again removing old unsound concrete and leaving as far as possible old, sound concrete, in place.

The extension arm 32 is against moved a predetermined increment, and the operation continues until the extension arm is fully retracted. Clearly, the operation can also be commenced with the arm fully retracted, and it can be progressively extended, if desired. In either case the vehicle remains stationary during operation of the water jet.

When extension arm 32 has been either fully extended or fully retracted (depending on whether the vehicle is being operated in a forward or reverse direction) hydraulic cylinders 92 are operated to lower vehicle 10 to surface 14. The extension arm 32 is again extended (or retracted, as the case may be) to its starting position. The operator then drives vehicle 10 to a new position so that the nozzle 67 is located to continue removing concrete from the work face 19 at the point where it left off. Hydraulic cylinders 92 are operated again to raise vehicle 10 off of surface 14. Operation then continues until the desired amount of concrete has been removed.

Throughout these operations pump 82 and motor 80 will normally run continuously. Flow of extra-high pressure water will be controlled by the operator so as to flow either to nozzle 67 or through bypass 86 back to tank 84.

In automatic operation, position transducers 130, 132, and 134 operate to deliver position signals regarding nozzle 67 to extension controller 136, vertical controller 138 and transverse controller 140, respectively. When appropriate, controllers 136, 138 and 140 will cause the adjustment of or increment the position of nozzle 67 accordingly.

It will be appreciated that suitable shroud means could be provided to prevent loose rock and debris from flying about the work site, and to reduce noise.

Figure 8:
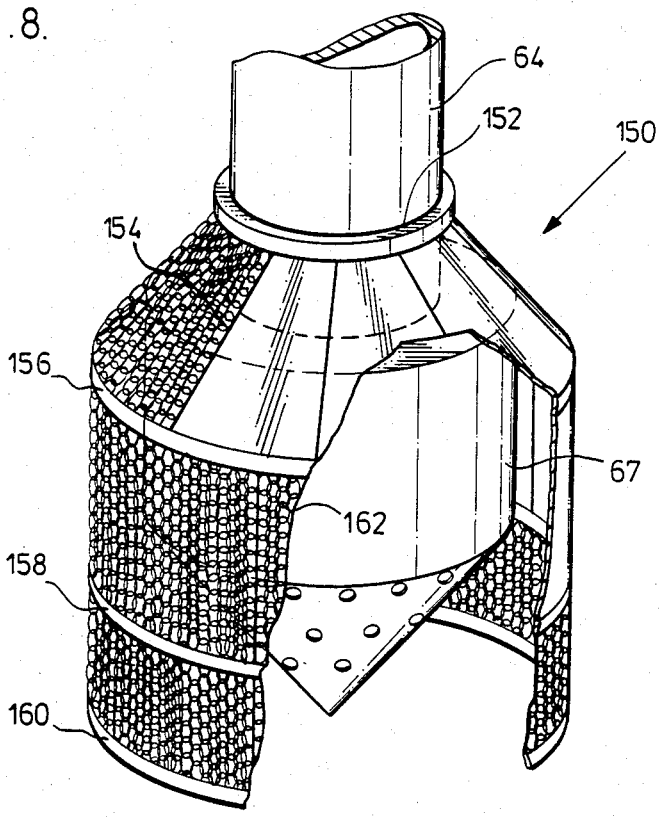

FIG. 8 illustrates a shroud 150, as it is attached to housing 61 to surround nozzle 67. Shroud 150 includes a support ring 152 attached to the lower end of housing 61 by suitable means (not shown). Chain segments 154 are attached to support ring 152. Chain segments 154 extend outwardly and downwardly to a second ring 156. Chain segments 154 then depend downwardly to third and fourth rings 158 and 160, respectively. Thus, support ring 152 holds chain segments 154, which in turn support ring 156, 158 and 160. The entire shroud 150 hangs downwardly in a manner similar to an oriental paper lantern. Proceeding circumferentially around shroud 150, chain segments 154 define angular gaps at intervals, between the support ring 152, and the second ring 154 and between the second ring 154 and the third ring 158. In such gaps, protector plates 162 are affixed between the rings 152, 156 and 158. Chain segments 154 depend downwardly around the entire perimeter of shroud 150 between third and fourth rings 158 and 160.

In operation, shroud 150 satisfactorily prevents loose debris or rubble adjacent the work face 17 from being ejected about the construction site. Operation of vehicle 10 with shroud 150 is thus safer.

It will be appreciated that shroud 150 may be modified to provide a sound barrier means on the exterior of chain segments 154 and plates 162 for reduced noise operation. It is also possible to provide a separate sound reducing shroud.

Although the invention has been described in relation to the removal of concrete surfaces, it will be understood that the inventive principles may be equally applied to other surfaces, such as rock, asphalt or other surfaces.

Furthermore, with suitable shop modifications, the method and device according to the invention may be applied for boring holes in concrete. In such a case, a modified nozzle head can be used having one jet along a vertical axis, and one, or more, on a cone axis. Head support block 44 is held fixed relative to nozzle support member 40. Hydraulic cylinder 52 is operated to lower nozzle 67. As the jets strike into the strata old unsound concrete is progressively removed. Lowering nozzle 67 will cause the boring of a hole through the unsound concrete. Of course, it will be appreciated that by using a suitable ultra-high pressure, the apparatus may also bore through both sound and unsound concrete.

Having described what is believed to be the best mode by which the invention may be performed, it will be seen that the invention may be particularly defined as follows:

Apparatus for removing material from a surface, for use in association with a source of water at a pressure within the range of about 10,000 to 25,000 psi, the apparatus comprising a carriage vehicle means, extendable arm means mounted on the vehicle means and defining a free end, a transverse nozzle support member attached to the free end of said arm, rotatable nozzle means movably attached to said support member, the nozzle means being movable in a transverse direction, and including a housing and a rotating nozzle mounted thereto, transverse movement means for transversely moving said nozzle means along said support member, hose means connecting the source of water to the nozzle means, motor means attached to the nozzle means operable to rotate said rotating nozzle, and, extender means attached between the arm and the vehicle means operable to extend and retract the arm relative to the vehicle means.

The invention further comprises a method for removing material from a surface comprising the steps of pressurizing water to a pressure within the range of about 10,000 to 25,000 psi, passing said pressurized water through nozzle means, directing at least two separate water jets from said nozzle means, oriented at two different angles relative to a vertical axis, rotating such nozzle means whereby to establish circular path for at least one of such water jets on such surface to establish turbulent water flow thereon to break up material to wash away loose material, traversing the nozzle in a first direction from one side to another to define a scan, and, moving the nozzle intermittently in a second direction essentially perpendicular to the first direction at the completion of at least one scan.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. Apparatus for removing material from a surface, for use in association with a source of water at a pressure within the range of about 10,000 to 25,000 psi, the apparatus comprising;

a carriage vehicle means;

extendable arm means mounted on the vehicle means and defining a free end, said arm means being movable along a linear path away from and towards said vehicle means and defining a longitudinal axis lying in a predetermined plane;

a transverse nozzle support member attached to the free end of said arm means;

transverse nozzle movement means on said support member;

rotatable nozzle means movably attached to said support member, said nozzle means being movable to and fro along a linear transverse path defining a transverse axis lying in a predetermined plane, and being operable to direct a water jet at an angle onto said surface over a circular zone of predetermined width;

hose means connecting said source of water to said nozzle means;

motor means attached to said nozzle means operable to rotate said nozzle means, and, power operated means attached to said arm means operable to extend and retract said arm means relative to said vehicle means along said longitudinal axis by increments equal to said predetermined width of said circular zone of said jet.

2. An apparatus for removing material from a surface as claimed in claim 1 including a support head movably attached to said support member, and vertical movement means connected between said support head and said nozzle means whereby the height of said nozzle means above said surface may be adjusted.

3. An Apparatus for removing material from a surface as claimed in claim 2 including limit switch means attached to both ends of said nozzle support member, each limit swich means being at least connected to said transverse movement means whereby said limit switch means may control transverse movement of said support head.

4. An apparatus for removing material from a surface as claimed in claim 3 wherein said carriage vehicle means includes sleeve means and wherein said extendable arm means is slidably mounted within said sleeve means.

5. An apparatus for removing material from a surface as claimed in claim 4 wherein said power operated means comprises a hydraulic cylinder attached between said sleeve member and said extendable arm, said hydraulic cylinder being connected to a source of pressurized hydraulic fluid.

6. An apparatus for removing material from a surface as claimed in claim 5 wherein said motor means comprises a hydraulic motor connected to said source of pressurized hydraulic fluid.

7. An apparatus for removing material surface as claimed in claim 6 wherein said transverse movement means comprises a hydraulic motor connected to said source of pressurized hydraulic fluid said hydraulic motor including a drive shaft, a first sprocket attached to said drive shaft, a chain connected to one side of said support head passing around said first sprocket, a second sprocket rotatably attached to said nozzle support member on the other side of the support head, and the chain passing therearound and connecting to the other side of said support head.

8. An apparatus for removing material from a surface as claimed in claim 7 wherein said vertical movement means comprises a hydraulic cylinder connected between said support head and said nozzle means.

9. An apparatus for removing material from a surface as claimed in claim 1 wherein said carriage vehicle means includes a chassis, wheels attached to said chassis, and jack means attached to said chassis adjacent each of said wheels, whereby said carriage vehicle means may be raised above said surface.

10. An apparatus for removing material as claimed in claim 1 wherein said material of said surface is concrete.

11. An apparatus for removing material from a surface as claimed in claim 1 including a shroud means connected to said rotatable nozzle means, whereby said shroud means depends downwardly around said nozzle down to said surface.

12. An apparatus for removing material from a surface as claimed in claim 1 including position indicator means connected to said arm means and operable to indicate the position of said arm means along said longitudinal axis.

13. A method for removing material from a surface comprising the steps of pressurizing water to a pressure within the range of 10,000 to 25,000 psi;

at a first location passing said pressurized water through nozzle means supported on a movable carriage;

directing at least two separate water jets from said nozzle means, oriented at two different angles relative to a vertical axis;

rotating said nozzle means whereby to establish a circular zone of predetermined width for said water jets on said surface to establish turbulent water flow thereon to break up material and to wash away loose material;

traversing said nozzle means relative to said carriage along a transverse linear axis from one side to another establishing a transverse path of said jets having a width equal to said predetermined width whereby to define a scan and stopping said traversing of said nozzle means;

moving said nozzle means relative to said carriage along a second linear axis perpendicular to said first axis at the completion of at least one said scan by an increment equal to said predetermined width, and stopping said movement;

again tranversing said nozzle means to define another scan parallel to and alongside said first mentioned scan;

repeating said traversing and incremental movement a predetermined number of times, and then stopping same;

moving said carriage and stopping at second location, and, repeating said steps, in sequence, whereby to progressively remove said material from said surface.

14. A method for removing material from a surface as claimed in claim 12 including the additional step of adjusting the height of said nozzle means above said surface prior to passing pressurized water therethrough.

* * * * *